United States Patent [19]

Schweickart

[11] 4,149,955

[45] Apr. 17, 1979

[54] FEEDING OF BRINE TO CHLOR-ALKALI CELLS

[75] Inventor: Albert J. Schweickart, Southgate, Mich.

[73] Assignee: BASF Wyandotte Corporation, Wyandotte, Mich.

[21] Appl. No.: 735,185

[22] Filed: Oct. 26, 1976

[51] Int. Cl.[2] ..... C25B 1/16; C25B 1/26; C25B 9/00

[52] U.S. Cl. ..... 204/275; 137/260; 204/279; 204/255

[58] Field of Search ..... 204/275, 279, 263, 257, 204/269, 255; 137/260, 433, 559, 588

[56] References Cited

U.S. PATENT DOCUMENTS

| | | | |
|---|---|---|---|
| 679,050 | 7/1901 | Girouard | 204/279 |
| 1,191,356 | 7/1916 | Smith | 204/275 X |
| 2,669,122 | 2/1954 | Silsby, Jr. | 204/275 X |
| 2,673,232 | 3/1954 | Silsby, Jr. | 204/275 X |
| 3,418,232 | 12/1968 | Emery | 204/263 |
| 3,471,382 | 10/1969 | Grotheer | 204/263 X |

*Primary Examiner*—Arthur C. Prescott
*Attorney, Agent, or Firm*—John W. Linkhauer; Bernhard R. Swick; Robert E. Dunn

[57] ABSTRACT

There is used a structure modified so that the brine-introduction tube is mounted within a larger-diameter tube sealingly mounted in the brine-introduction opening in the side of the cell top, with an orifice member preferably being mounted within an end of the brine-introduction tube nearer to the cell. This makes it possible to avoid unwanted variations in the brine flow rate and to see instantly whether an orifice member is clogged.

4 Claims, 1 Drawing Figure

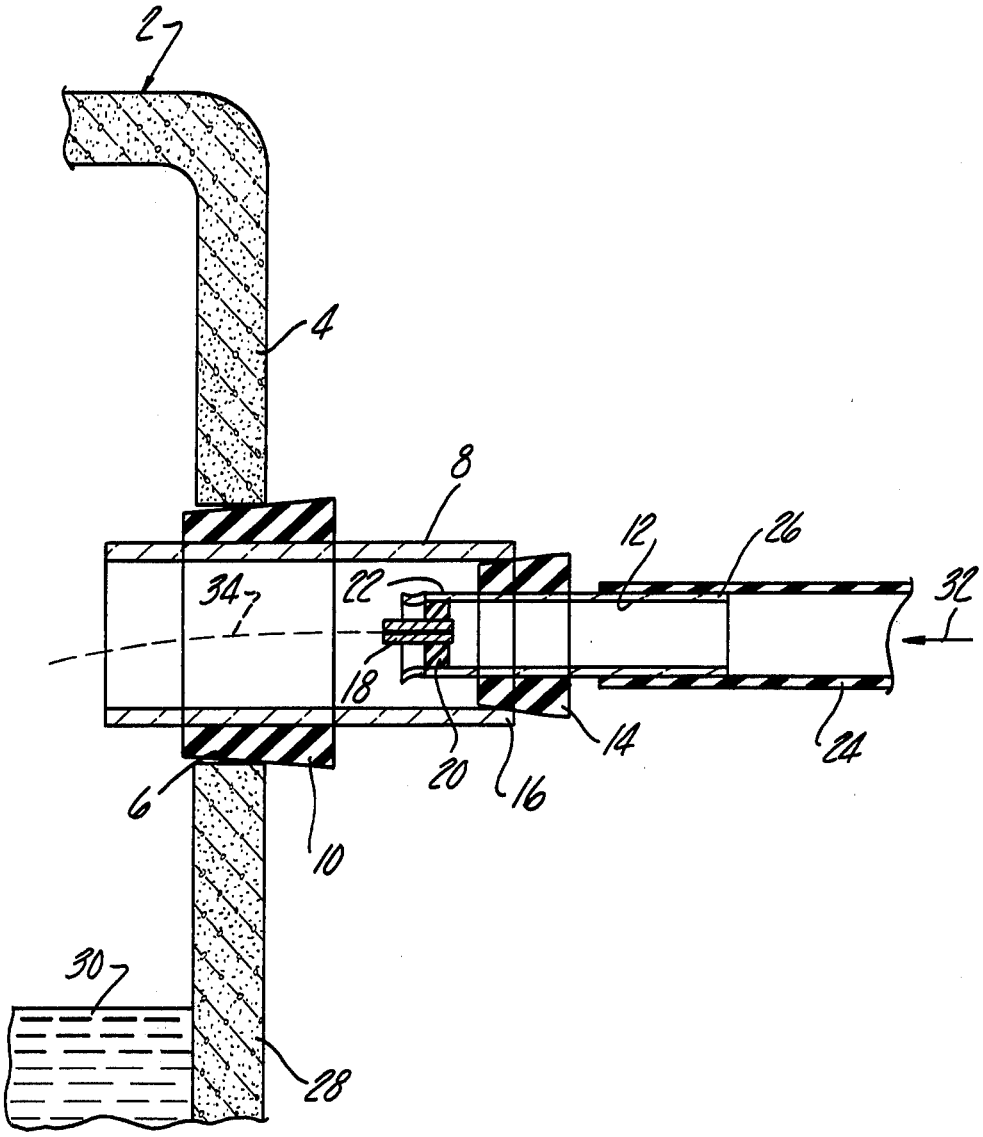
2
4
8
12
26
32
34
22
18
20
16
14
24
6
10
30
28

FEEDING OF BRINE TO CHLOR-ALKALI CELLS

BACKGROUND OF THE INVENTION

1. Field of the Invention

The invention relates to brine-feeding means for, inter alia, diaphragm-type electrolytic cell apparatus. Though the invention may be practiced with respect to a single cell, it is likely to be used with a plurality of cells, such as all the cells in a chlor-alkali cell room.

2. Description of the Prior Art

Although there have been suggestions in the prior art of brine-cell feeding structures that are more complicated or introduce the brine vertically or below the liquid level in the cell (see, for example, U.S. Pat. Nos. 1,924,822; 2,669,122; and 2,673,232), the usual practice has been to introduce the brine through a brine introduction tube which is about 16 millimeters (⅝ inch) in outside diameter and has a resilient brine-supply line connected to its outside end, covering where the orifice member is located.

The structure described above has a few drawbacks. It is not possible to tell, without disengaging the brine supply line, whether an orifice is clogged or the difficulty is upstream of the orifice. Even more troublesome is the variation in brine flow rate which occurs, because with such apparatus, either of two modes of flow may occur. In one mode, which can be called "normal flow", the brine enters the cell in the form of a jet, as is desirable. In another mode, which can be called "siphon flow", the brine-introduction tube inboard of the orifice becomes filled with liquid, and when this happens, there are two main effects: (1) even with the same hydrostatic head from the brine-supply line, the rate of introduction of brine to the cell increases by about 15 percent, and (2) the leakage current through the brine-supply line increases from about 0.1 milliampere to a high value, possibly as much as 1 ampere. With the apparatus used prior to the present invention, such changes in mode of flow have occurred sporadically and unpredictably, making it relatively more difficult to keep a roomful of cells operating upon a smooth basis. The strength of the caustic produced by an individual cell is importantly influenced by the brine flow-rate, and it is also important to maintain liquid levels in the cells within design limits to avoid safety hazards.

SUMMARY OF THE INVENTION

There is used a structure modified so that the brine-introduction tube is mounted within a larger-diameter tune sealingly mounted in the brine-introduction opening in the side of the cell top, with an orifice member preferably being mounted within an end of the brine-introduction tube nearer to the cell. This makes it possible to avoid unwanted variations in the brine flow rate and to see instantly whether an orifice member is clogged.

DESCRIPTION OF THE DRAWING

A complete understanding of the invention may be obtained from the foregoing and following description thereof, taken in conjunction with the appended drawing, the sole FIGURE of which is a central sectional view in elevation of a brine-feed apparatus in accordance with the invention.

DESCRIPTION OF THE PREFERRED EMBODIMENTS

Referring to the drawing, there is shown a cell top 2 having a vertically extending side portion 4, which has therein an opening 6. In accordance with the invention there is provided a first tube 8, preferably of glass, and having an outside diameter of over 25 millimeters. Surrounding the tube 8 is a rubber stopper 10, which serves as a means for sealingly mounting the tube 8 within the opening 6.

Also shown is a second tube 12, also preferably of glass, although either of the tubes 8 and 12 may be made of any transparent material which is adequately strong and resistant to the action of brine. The tube 12 is of ten to twenty-six millimeters in outside diameter and is surrounded by a rubber stopper 14 or other suitable means for permitting it to be mounted in the end 16 of the tube 6 which is located exteriorly of the cell 2.

There is also provided an orifice member 18, having around it a rubber packing 20, or other means whereby it is sealingly mounted within the tube 12, and within the end 22 of the tube 12 which is proximal to the cell 2. The orifice member 18 may be made of any material satisfactorily resistant to the action of brine; satisfactory results have been obtained with the use of an orifice member made of tantalum metal. In a typical case, the orifice member has an outside diameter of 0.27 to 0.44 inches (6.9 to 11.2 millimeters) and an orifice opening 0.15 or 0.40 inches (3.8 to 10.1 millimeters) in diameter. With any usual head, such as 0.8 to 2.2 meters, an orifice opening as mentioned above will usually provide a flow rate on the order of 2 to 15 liters per minute. The desirable flow rate, within the foregoing range, depends upon the capacity of the individual cell involved; a flow rate of about 6 liters per minute would not be unusual.

A flexible brine-supply line 24 is snugly fitted over the end 26 of tube 12 which is distal from the cell 2.

The cell top 2 fits upon the cell bottom 28. The level of liquid 30 within the cell is also indicated.

The mode of operation of the apparatus disclosed above is self-evident. Brine is supplied as indicated at 32, passing as a narrow stream 34 from the orifice member 18. Inasmuch as the brine-supply line 24 does not cover the vicinity of the orifice member 18, the operator can see instantly whether a stream 34 of flow is being produced, and if it is not, whether liquid is being supplied to the orifice member 18 or not.

The structure disclosed makes it possible to restore a cell to proper operation quickly and conveniently in the event that the orifice member 18 becomes plugged, or an adjustment in the rate of feeding brine to the cell is required. The stopper 14 is removed from the end 16 of the tube 8, and if desired, the entire sub-assembly comprising the tube 12, stopper 14, orifice member 18, and packing 20, may be detached from the brine-supply line 24 and replaced with a similar assembly containing an unclogged orifice of appropriate size. Alternatively, the orifice member 18 may be removed and replaced or be returned after cleaning.

Those skilled in the art will appreciate that the principles of the invention are applicable regardless of the precise dimensions of the tubes 8 and 12. Satisfactory results have been obtained with the use of the tube 8 having an outside diameter of approximately thirty millimeters (1 3/16 inches) and a tube 12 having an outside diameter of approximately 15.6 millimeters (⅝ inch), both tubes being made of thick-walled low-expansion glass.

Those skilled in the art will also appreciate, from what has been said above, that it would be possible to practice the present invention in a different way. It is possible to make an integral structure, which may be molded of clear plastic, providing in one easily produced piece an item which supplants the tubes 8 and 12 and the stopper 14. In this embodiment of apparatus of the invention, there are thus provided in one integral piece both a "first tube means" of larger diameter, corresponding to the tube 8, and a "second tube means", corresponding to the tube 12 in the structure illustrated in the FIGURE.

Although there have been shown and described herein certain embodiments of the invention, it is intended that there be covered as well any change or modification therein which may be made without departing from the spirit and scope of the invention.

The embodiments of the invention in which an exclusive property or privilege is claimed are defined as follows:

1. In combination with a chlor-alkali cell having a cell top, said top having in a vertically extending side portion thereof a brine-introduction opening, said opening being located above the level of liquid within said cell, apparatus for providing a constant flow of brine to said cell, said apparatus comprising, in combination, a first tube means of over 25 millimeters in outside diameter, means sealingly mounting said first tube means in said opening, second tube means of approximately ten to twenty-six millimeters in outside diameter, means sealingly mounting said second tube means within an end of said first tube means exteriorly of said cell, an orifice member sealingly mounted within said second tube and within an end portion thereof which is proximal to said cell, and a resilient brine-supply line operatively engaged with an end of said second tube means distal from said cell.

2. Apparatus as defined in claim 1, wherein said first tube means is a tube of transparent material.

3. Apparatus as defined in claim 2, wherein said brine-supply line is so attached to said second tube means that the vicinity of said orifice member is visible to an operator of the cell.

4. Apparatus as defined in claim 1, wherein said brine-supply line is so attached to said second tube means that the vicinity of said orifice member is visible to an operator of the cell.

* * * * *